US011152729B2

(12) United States Patent
Martens et al.

(10) Patent No.: US 11,152,729 B2
(45) Date of Patent: Oct. 19, 2021

(54) ELECTRICAL CONNECTOR AND ELECTRICAL CONNECTOR ASSEMBLY HAVING A MATING ARRAY OF SIGNAL AND GROUND CONTACTS

(71) Applicant: TE CONNECTIVITY CORPORATION, Berwyn, PA (US)

(72) Inventors: Rodney Ivan Martens, Mechanicsburg, PA (US); John Joseph Consoli, Harrisburg, PA (US); Arturo Pachon Munoz, Harrisburg, PA (US); Chad William Morgan, Carneys Point, NJ (US); Douglas Edward Shirk, Elizabethtown, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/144,566

(22) Filed: Sep. 27, 2018

(65) Prior Publication Data

US 2019/0036256 A1 Jan. 31, 2019

Related U.S. Application Data

(63) Continuation-in-part of application No. 15/840,177, filed on Dec. 13, 2017, which is a continuation of (Continued)

(51) Int. Cl.
*H01R 13/03* (2006.01)
*H01R 13/6587* (2011.01)
(Continued)

(52) U.S. Cl.
CPC ..... *H01R 13/03* (2013.01); *H01R 13/514* (2013.01); *H01R 13/658* (2013.01); *H01R 13/6587* (2013.01); *H01R 13/6598* (2013.01)

(58) Field of Classification Search
CPC ..... H01R 13/03; H01R 13/514; H01R 13/658
(Continued)

(56) References Cited

U.S. PATENT DOCUMENTS 4,655,519 A * 4/1987 Evans ..... H05K 7/1069 439/514
4,910,094 A * 3/1990 Watanabe ..... B23K 20/233 257/E23.072
(Continued)

FOREIGN PATENT DOCUMENTS

CN 101384755 A 3/2009
CN 101682135 A 3/2010
(Continued)

OTHER PUBLICATIONS

GIG-ARRAY® High Speed Mezzanine Connectors 15-35 mm Board to Board (GS-12)-192 (Oct. 20, 2007).
(Continued)

*Primary Examiner* — Alexander Gilman

(57) ABSTRACT

Electrical connector includes a housing and a mating array having a plurality of signal contacts and a plurality of ground contacts that are coupled to the housing. The signal contacts and the ground contacts are positioned for mating with signal conductors and ground conductors, respectively, of a mating connector. The ground contacts are plated with a ground-material composition and the signal contacts are plated with a signal-material composition. The ground-material composition is configured to cause a first low-level contact resistance (LLCR) while mated with the ground conductors during operation. The signal-material composition is configured to cause a second LLCR while mated with the signal conductors during operation. The second LLCR is less than the first LLCR during operation.

21 Claims, 8 Drawing Sheets

Related U.S. Application Data application No. 15/350,710, filed on Nov. 14, 2016, now Pat. No. 9,859,640.

(51) Int. Cl.
*H01R 13/514* (2006.01)
*H01R 13/658* (2011.01)
*H01R 13/6598* (2011.01)

(58) Field of Classification Search
USPC ..... 439/607.23
See application file for complete search history.

(56) References Cited

U.S. PATENT DOCUMENTS 4,925,407 A * 5/1990 Hauser ..... H01H 1/021 439/886
5,066,550 A * 11/1991 Horibe ..... H01H 11/041 200/266
5,351,396 A * 10/1994 Sawada ..... H01H 1/0233 29/877
6,755,958 B2 * 6/2004 Datta ..... C23C 28/021 205/176
7,758,351 B2 * 7/2010 Brown ..... H01R 43/16 439/66
8,398,431 B1 3/2013 Whiteman, Jr. et al.
8,398,433 B1 * 3/2013 Yang ..... H01R 31/08 439/108
8,408,939 B2 4/2013 Davis et al.
8,652,649 B2 * 2/2014 Cahalen ..... C23C 28/00 428/665
9,214,768 B2 * 12/2015 Pao ..... H01R 13/6587
9,312,618 B2 * 4/2016 Regnier ..... H01R 9/2408
9,413,112 B2 * 8/2016 Helster ..... H01R 13/6467
9,859,640 B1 1/2018 Horning et al.
2004/0175937 A1 * 9/2004 Orwoll ..... B23H 9/001 438/674
2005/0142900 A1 * 6/2005 Boggs ..... H01R 13/2407 439/66
2006/0216969 A1 * 9/2006 Bright ..... H01R 23/688 439/79
2007/0243741 A1 * 10/2007 Yang ..... H01R 13/4364 439/304
2010/0144168 A1 6/2010 Glover et al.
2010/0144169 A1 * 6/2010 Glover ..... H01R 12/585 439/68
2010/0144201 A1 6/2010 Defibaugh et al.
2010/0173530 A1 * 7/2010 Tsai ..... H01R 27/00 439/660
2011/0212633 A1 * 9/2011 Regnier ..... H01R 9/038 439/95
2011/0300757 A1 * 12/2011 Regnier ..... H01R 29/00 439/626
2012/0034820 A1 * 2/2012 Lang ..... H01R 13/65802 439/660
2012/0129395 A1 5/2012 Davis et al.
2012/0188865 A1 * 7/2012 Michaelis ..... G01R 31/043 370/200
2013/0092429 A1 * 4/2013 Ellison ..... H01R 12/523 174/264
2013/0115821 A1 * 5/2013 Golko ..... H01R 13/516 439/638
2014/0045352 A1 * 2/2014 Weber ..... H01R 13/03 439/78
2014/0073174 A1 * 3/2014 Yang ..... H01R 13/6461 439/485
2014/0073181 A1 * 3/2014 Yang ..... H01R 13/6471 439/607.01
2014/0287262 A1 9/2014 Kato et al.
2016/0013596 A1 * 1/2016 Regnier ..... H01R 12/585 439/607.35
2016/0064846 A1 * 3/2016 Tadokoro ..... H01R 13/03 439/886
2016/0181713 A1 * 6/2016 Peloza ..... H01R 12/724 439/630
2016/0197423 A1 * 7/2016 Regnier ..... H01R 13/6473 439/59
2016/0247592 A1 * 8/2016 Sawada ..... H01B 1/026
2016/0372276 A1 * 12/2016 Han ..... H01H 11/04
2017/0253983 A1 * 9/2017 Cahalen ..... B32B 15/018
2018/0151997 A1 * 5/2018 Busies ..... H01R 13/04
2019/0036256 A1 * 1/2019 Martens ..... H01R 13/6587

FOREIGN PATENT DOCUMENTS

CN 201732698 U 2/2011
CN 203800219 U 8/2014
JP H1167308 A 3/1999

OTHER PUBLICATIONS

ExalMAX® Connector System (GS-12-1096 (Nov. 12, 2018)), 15 pages.
Z-Pack TinMan Connector System (108-2303 Rev. B (Jul. 20, 2011)), 8 pages.
Fortis ZD Modular Connector System (108-2409 Rev. D (Jun. 29, 2012), 6 pages.
Two, Three and Four Pair HM-ZD Connectors (108-2055 Rev. B (Apr. 4, 2005))., 8 pages.

* cited by examiner

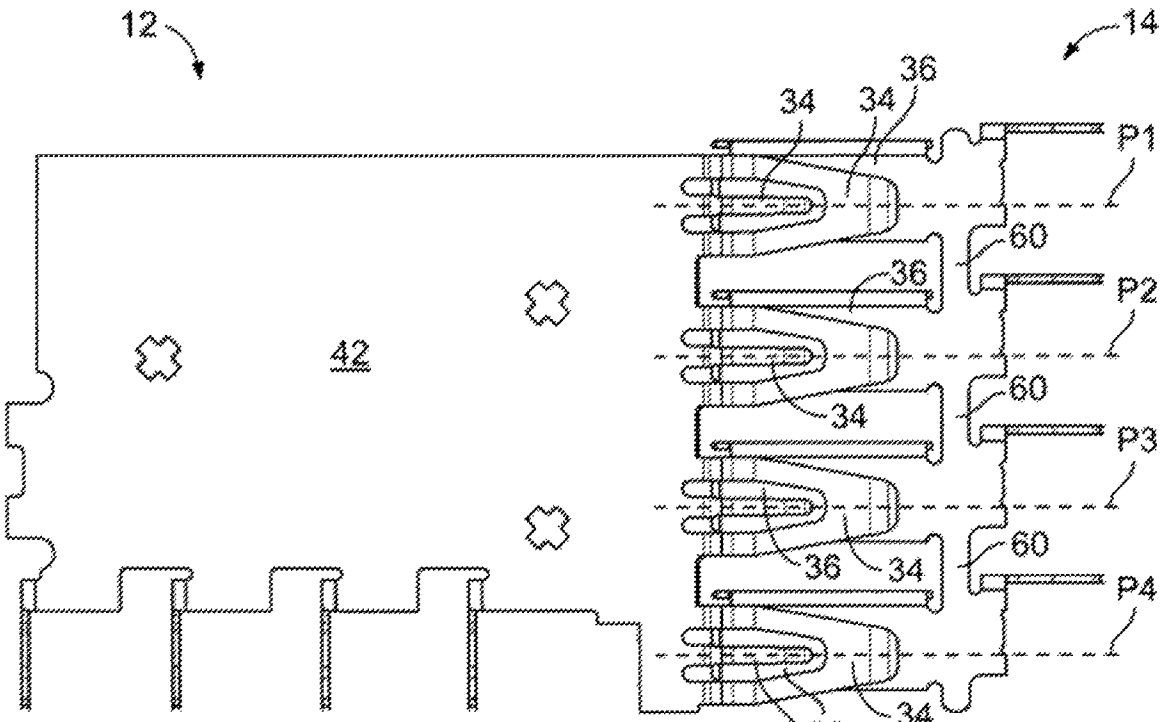
FIG. 4
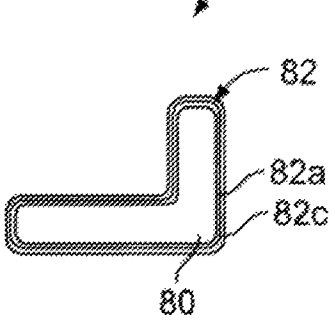
FIG. 6
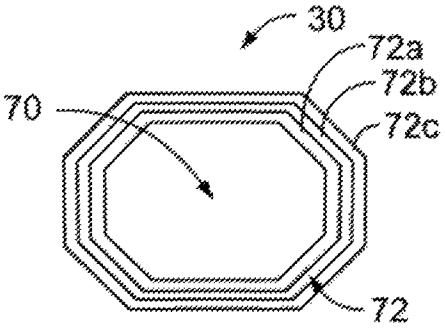

ELECTRICAL CONNECTOR AND ELECTRICAL CONNECTOR ASSEMBLY HAVING A MATING ARRAY OF SIGNAL AND GROUND CONTACTS

RELATED APPLICATIONS

The present application is a continuation-in-part of U.S. application Ser. No. 15/840,177, filed on Dec. 13, 2017, which is a continuation of U.S. application Ser. No. 15/350,710 (now U.S. Pat. No. 9,859,640), filed on Nov. 14, 2016, each of which is incorporated herein by reference in its entirety, including the specification, claims, drawings, and abstract.

BACKGROUND OF THE INVENTION

The subject matter herein relates generally to electrical connectors having plated signal contacts.

The electrical contacts of many known electrical connectors are often plated to improve the electrical performance and mechanical reliability of the connector. For example, the base materials of the signal and ground contacts of higher-speed connectors are often plated with one or more other materials (e.g., precious metals, alloys thereof, and/or the like) that provide the contacts with a lower contact resistance. Moreover, the base material of the electrical contacts of some connectors is plated with one or more materials (e.g., nickel (Ni), alloys thereof, and/or the like) that increase the durability of the contacts to reduce the wear generated from repeated mating and de-mating of the electrical connector. But, plating the signal and ground contacts of an electrical connector can be expensive and thereby increase the cost of manufacturing the connector, particularly when the plating includes a precious metal.

There is a need to reduce cost for contacts of an electrical connector without sacrificing electrical performance of the electrical connector.

BRIEF DESCRIPTION OF THE INVENTION

In an embodiment, an electrical connector is provided. The electrical connector includes a housing and a mating array having a plurality of signal contacts and a plurality of ground contacts that are coupled to the housing. The signal contacts and the ground contacts are positioned for mating with signal conductors and ground conductors, respectively, of a mating connector. The ground contacts are plated with a ground-material composition and the signal contacts are plated with a signal-material composition. The ground-material composition is configured to cause a first low-level contact resistance (LLCR) while mated with the ground conductors during operation. The signal-material composition are configured to cause a second LLCR while mated with the signal conductors during operation. The second LLCR is less than the first LLCR during operation.

In some aspects, the signal-material composition and the ground-material composition differ by at least one of a material or a layer thickness.

In some aspects, the signal-material composition is configured to cause the second LLCR while mated with the signal conductors during operation if the second LLCR is at most 20 milliohms after applying an accelerated-aging protocol. The ground-material composition is configured to cause the first LLCR while mated with the ground conductors during operation if the first LLCR is at most 25 ohms after applying the accelerated-aging protocol. Optionally, the first LLCR is at least 10× greater than the second LLCR after applying the accelerated-aging protocol.

In some aspects, the ground-material composition is configured to cause the first LLCR while mated with the ground conductors during operation if the first LLCR increases by at least three times after an accelerated-aging protocol is applied. The signal-material composition is configured to cause the second LLCR while mated with the signal conductors during operation if the second LLCR increases by at most three times after the accelerated-aging protocol is applied. Optionally, the first LLCR is at most 10 ohms and the second LLCR is at most 20 milliohms. Also optionally, the first LLCR is at least 10× greater than the second LLCR after applying the accelerated-aging protocol.

In some aspects, the ground-material composition includes a plated layer that has a first thickness and the signal-material composition includes a plated layer that has a second thickness. The first thickness is less than the second thickness. Optionally, the first thickness is less than 0.30 micrometers and the second thickness is greater than 0.30 micrometers.

In some aspects, the signal-material composition includes outer and inner signal layers having first and second materials, respectively, and the ground-material composition includes outer and inner ground layers comprising the first and second materials, respectively. The outer layers of the signal-material composition and the ground-material composition have different thicknesses. Optionally, the ground-material composition comprises at least one of a nickel sulfamate ($Ni(SO_3NH_2)_2$), tin-nickel (Sn/Ni), nickel-phosphorus (NiP), nickel-tungsten (NiW), structured nickel, cobalt-phosphorus (CoP), dilute palladium-nickel (PdNi), chromium (Cr), zinc (Zn), zinc-nickel (ZnNi), zinc with steel, carbon, a carbon ink, or a carbon epoxy.

In some aspects, the signal-material composition includes outer and inner signal layers and the ground-material composition includes outer and inner ground layers. The outer layers of the signal-material composition and the ground-material composition have different materials. Optionally, the outer layer of the signal-material composition includes palladium-nickel (PdNi) and the outer layer of the ground-material composition includes gold (Au).

In an embodiment, an electrical connector assembly is provided. The electrical connector assembly includes a mating connector having signal conductors and ground conductors. The electrical connector assembly also includes an electrical connector having a housing and a mating array that includes a plurality of signal contacts and a plurality of ground contacts that are coupled to the housing. The signal contacts and the ground contacts are positioned for mating with the signal conductors and the ground conductors, respectively, of the mating connector. The ground contacts are plated with a ground-material composition, and the signal contacts are plated with a signal-material composition. The ground-material composition and the ground conductors mating with each other at respective ground interfaces, and the signal-material composition and the signal conductors mating with each other at respective signal interfaces. The ground interfaces have a first low-level contact resistance (LLCR) and the signal interfaces have a second LLCR. The second LLCR is less than the first LLCR.

In an embodiment, an electrical connector is provided that includes a housing and a mating array having a plurality of signal contacts and a plurality of ground contacts that are coupled to the housing. The signal contacts and the ground contacts are positioned for mating with signal conductors and ground conductors, respectively, of a mating connector.

The ground contacts have a plated layer that includes a precious metal, and the signal contacts have a plated layer that includes the precious metal. The plated layers of the ground contacts and the plated layers of the signal contacts have different thicknesses. The thickness of the plated layers of the signal contacts is greater than the thickness of the plated layers of the ground contacts.

In some aspects, the ground contacts are configured to cause a first low-level contact resistance (LLCR) while mated with the ground conductors during operation. The signal contacts are configured to cause a second LLCR while mated with the signal conductors during operation. The second LLCR is less than the first LLCR during operation. Optionally, the first LLCR is at least 10× greater than the second LLCR after applying an accelerated-aging protocol.

BRIEF DESCRIPTION OF THE DRAWINGS

FIG. 4 is an elevational view of a portion of the receptacle connector shown in FIG. 2 and a portion of the header connector shown in FIG. 3 illustrating the connectors mated together.

FIG. 6 is a cross-sectional view of an embodiment of a signal contact and a ground shield of the header connector shown in FIG. 3.

DETAILED DESCRIPTION OF THE INVENTION

Figure 1:
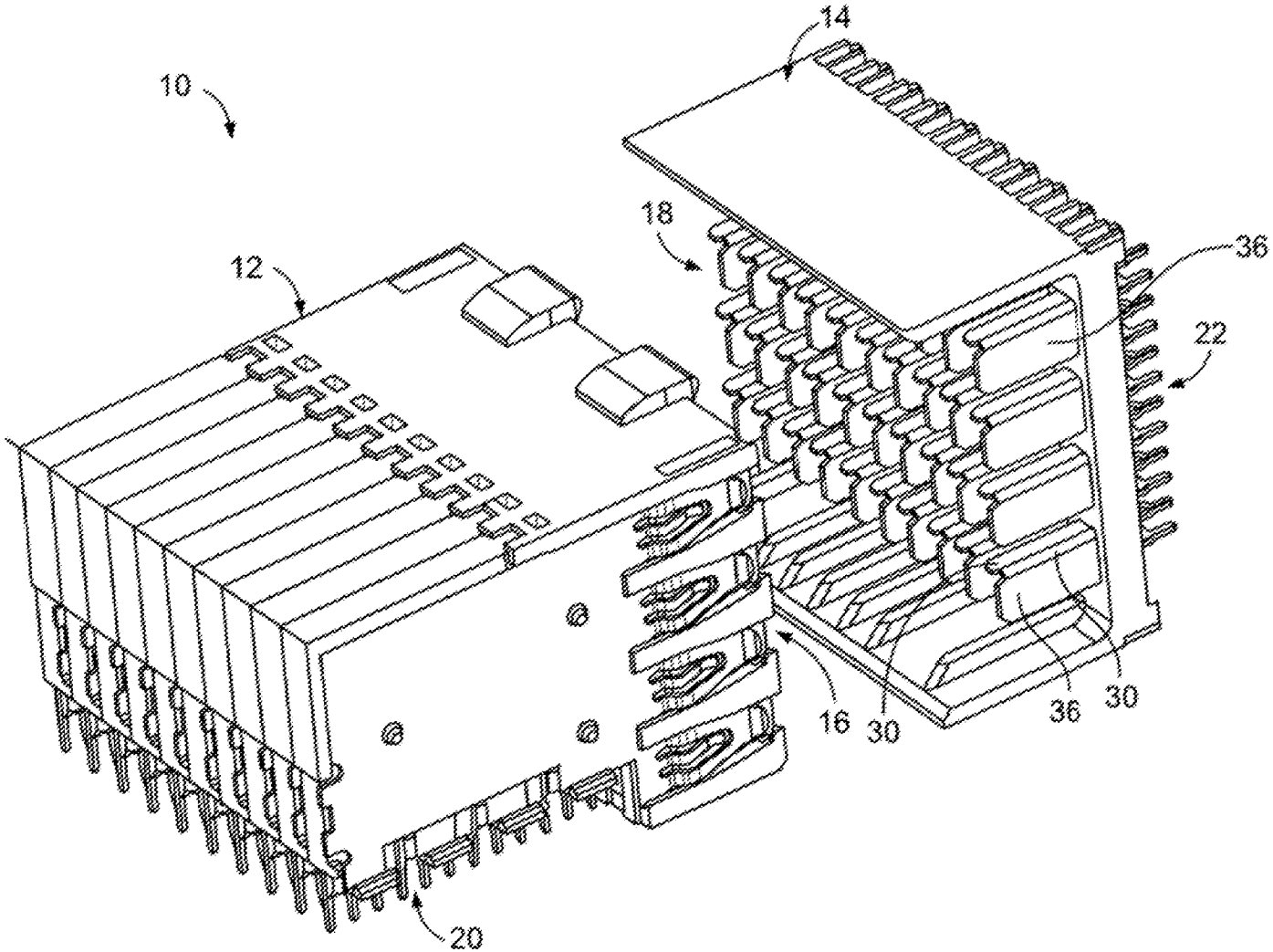
FIG. 1 is a perspective view of an embodiment of an electrical connector system.

At least some embodiments described herein include signal contacts that are configured to have a designated low-level contact resistance during operation and ground contacts that are permitted to have a low-level contact resistance during operation that is greater than the designated low-level contact resistance of the signal contacts. A total resistance experienced by a communication system includes an intrinsic (or bulk) resistance and low-level contact resistance (hereinafter referred to as "LLCR") provided by interfaces between two conductors. For example, an electrical contact of a plug connector engages an electrical contact of a receptacle connector at an interface. This interface has an electrical contact resistance at the interface. The Low Level Contact Resistance or LLCR test methodology used to measure this electrical resistance employs low levels of current and voltage to ensure that any insulated films that may be present are not broken or contact asperities are not melted by the resistance measurement process. The voltage and current used to measure or determine LLCR may be, for example, 20 mV (max) open circuit at 100 mA.

Electrical contacts described herein may include a plurality of different materials. For example, an electrical contact may include a base material, such as copper or copper alloy (e.g., beryllium copper), that is plated or coated with one or more other materials. As used herein, when another material is "plated over" or "coated over" a base material, the other material may directly contact or bond to an outer surface of the base material or may directly contact or bond to an outer surface of an intermediate material. More specifically, the other material is not required to be directly adjacent to the base material and may be separated by an intermediate layer.

LLCR may be associated with a thickness of a plated layer, among other factors. At least some embodiments described herein also include ground contacts having a plated layer that includes a precious metal and signal contacts having a plated layer that includes a precious metal, which may or may not be the same precious metal. The plated layers of the ground contacts and the plated layers of the signal contacts may have different thicknesses in which the thickness of the plated layers of the signal contacts is greater than the thickness of the plated layers of the ground contacts. LLCRs for ground contacts having thinner plated layers may be more likely to increase after manufacturing.

LLCR corresponds to an interface between two surfaces that engage each other. For example, a signal contact engages another signal contact (also called signal conductor) at a signal interface (e.g., signal interface 90) and a ground contact engages another ground contact (also called ground conductor) at a ground interface (e.g., ground interface 92 (FIG. 5)). LLCR for each interface may be measured by determining the current and/or voltage at two different points on opposite sides of the interface. LLCR typically increases over time and with usage due to degradation processes. Degradation may occur, for example, through corrosion and wear and also through a decrease in the contact force that presses the two mated contacts against each other. These degradation processes decrease the total area along the interface at which the two mated contacts directly engage each other and effectively conduct current therebetween. Unlike signal and ground contacts in known systems, the signal and ground contacts set forth herein may have substantially different LLCRs. For example, after a period of operation, the LLCR of the ground contacts may be ten times (10×) greater than the LLCR of the signal contacts.

An electrical contact may include a plurality of layers. For example, an electrical contact may include a base layer (or base material), an optional intermediate layer or layers plated over the base layer, and an outer layer that is plated over the intermediate layer. The intermediate layer or layers may also be referred to as an inner layer or layers.

The base layer may include copper or a copper alloy or other metals or alloys, all of which can be susceptible to corrosion. This corrosion may be eliminated by plating the base material with one or more other materials. For example, passive metals, such as tin and/or nickel, may be plated onto the base layer. This passive metal may form an intermediate or barrier layer. A passive film (e.g., thin oxide film) may develop along the surface of the tin and/or nickel layer. This passive film may provide corrosion resistance and function as a protective barrier between the tin and/or nickel layer and the surrounding environment.

In some cases, a precious metal material, such as gold, gold alloy, palladium, palladium alloy, silver, and/or silver alloy, is plated onto the base material or an intermediate layer (e.g., tin and/or nickel layer). If this plated layer has a relatively small thickness (e.g., between 2 and 30 micro-inches (or 50.8 nm and 762 nm) depending upon the material), the plated layer may be referred to as a "flash layer." With or without the flash layer, a pore-blocking substance may be applied to an exterior surface of the electrical contact. The pore-blocking substance is configured to reduce corrosion along the exterior surface and may have a nominal effect upon the LLCR.

Accordingly, embodiments may include a mating array having a plurality of signal contacts and a plurality of ground contacts. The signal contacts and the ground contacts are positioned for mating with signal contacts and ground contacts, respectively, of a mating connector. For clarity, the signal and ground contacts of the mating connector may be referred to as signal and ground conductors, respectively. The ground contacts and the signal contacts may be plated with different material compositions and/or have layers with different thicknesses. Each material composition may have one or more layers.

For example, the ground contacts may be plated with a ground-material composition that is configured to cause a first low-level contact resistance (LLCR) while mated with the ground conductors during operation. The signal contacts may be plated with a signal-material composition configured to cause a second LLCR while mated with the signal conductors during operation. The second LLCR can be less than the first LLCR during operation.

Alternatively or in addition to the different material compositions, one or more plated layers of the signal contacts may have different thicknesses with respect to the same plated layer of the ground contacts. For example, in one configuration, the signal contacts may have an inner layer that comprises nickel and an outer layer that comprises palladium-nickel. The ground contacts of this configuration may have an inner layer that comprises nickel and an outer layer that comprises gold (e.g., flash gold). In another configuration, the signal contacts may have an inner layer that comprises nickel and an outer layer that comprises gold having a first thickness. The ground contacts of this configuration may have an inner layer that comprises nickel and an outer layer that comprises gold having a second thickness that is less than the first thickness. The outer layer may constitute a flash gold layer.

As used herein, when different material compositions are "configured to cause" different LLCRs, then the different material compositions have different properties or qualities that contribute to the differences between the LLCRs. In other words, the difference between the LLCRs is not caused exclusively by the contacts of the other connector. The differences between the LLCRs may be substantially caused by the material compositions of the recited contacts. For example, the materials that comprise the material composition (e.g., gold or palladium-nickel) and/or the thickness of the layer or layers of the material composition may be selected so that the differences in LLCR may occur. In some embodiments, the material composition for the ground contacts may be more cost-effective than the material composition for the signal contacts. Moreover, it should be understood that the phrase "configured to cause" does not mean mere capability in a hypothetical or theoretical sense but means a likelihood that the material composition will cause the LLCR if the electrical connector is used as expected.

Because LLCRs may increase over time, the LLCR may be determined when the contacts have a predetermined condition. For example, an accelerated-aging protocol may be applied to determine the LLCR that occurs at an end-of-life (EOL). The LLCR at EOL may represent an approximate maximum of the LLCR.

For example, the ground-material composition may be configured to cause a first LLCR while mated with the ground conductors during operation if the first LLCR is between 100 milliohms and 25 ohms after applying an accelerated-aging protocol. The signal-material composition may be configured to cause the second LLCR while mated with the signal conductors during operation if the second LLCR is at most 10 milliohms after applying the accelerated-aging protocol. In some embodiments, the first LLCR may be at least 10× greater than the second LLCR after applying the accelerated-aging protocol. In certain embodiments, the first LLCR may be at least 25× greater than the second LLCR after applying the accelerated-aging protocol. In particular embodiments, the first LLCR may be at least 50× greater than the second LLCR after applying the accelerated-aging protocol.

The accelerated-aging protocol may be provided by an industry standards test method. For example, one standard that may be used is Telcordia GR-1217-Core "Generic Requirements for Separable Electrical Connectors Used In Telecommunications Hardware." Such accelerated-aging protocols may be designed to address one or more degradation mechanisms that may be present for an electrical connector. The accelerated-aging protocols are typically comprised of tests or sequences of tests designed to address specific degradation mechanisms. When considering the outer-most metallic layer, it is appropriate to consider the degradation mechanisms specific to the outer-most metallic layer. The tests or test sequences addressing the outer-most metallic layers typically focus on wear and corrosion mechanisms.

Accelerated-aging protocols may include, for example, at least one of (a) repeatedly mating and un-mating the electrical contacts (see, e.g., EIA-364-TP09), thereby causing wear along the interfaces; (b) applying mechanical shock conditions (see, e.g., EIA-364-TP27); (c) applying random vibration conditions (see, e.g., EIA-364-TP28); (d) applying thermal shock cycles in which the temperature is significantly changed (e.g., about 150 degrees Celsius) (see, e.g., EIA-364-TP32); (e) applying cycles in which the humidity of the environment is repeatedly changed (see, e.g., EIA-364-TP31); (f) exposing the electrical connectors or contacts to dust (see, e.g., EIA-364-TP91); (g) exposing the electrical contacts to a sustained high temperature (see, e.g., EIA-364-TP17); and (h) applying mixed flowing gas (see, e.g., EIA-364-TP17, EIA-364-TP09, EIA-364-TP65 Class IIA).

Unless recited otherwise in the claims, the LLCR at EOL is measured or determined in a manner consistent with Telcordia GR-1217-Core.

In some embodiments, the signal contacts and the ground contacts, immediately after manufacturing and prior to usage or storage, may have an LLCR that is at most 10 milliohms or, more particularly, at most 5 milliohms. The ground contacts, however, may comprise a material that increases the contact resistance more rapidly than the signal contacts. For example, in some embodiments, the signal contacts may be at most 10 milliohms at EOL and the ground contacts may have at most 25 ohms at EOL. In certain embodiments, the signal contacts may be at most 10 milliohms at EOL and the ground contacts may have at most 20 ohms at EOL. In particular embodiments, the signal contacts may be at most 10 milliohms at EOL and the ground contacts may have at most 15 ohms at EOL. In more particular embodiments, the signal contacts may be at most 10 milliohms at EOL and the ground contacts may have at most 10 ohms at EOL. Yet in more particular embodiments, the signal contacts may be at most 10 milliohms at EOL and the ground contacts may have at most 5 ohms at EOL.

Signal and ground contacts may also be characterized as having different contact resistance stabilities. For known systems, the contact resistance stabilities for the signal and ground contacts are essentially the same. For example, for each of the signal contacts and the ground contacts, the contact resistance immediately after manufacturing and the contact resistance at EOL may not differ significantly (e.g., at most 15 milliohms). In some embodiments, however, the ground-material composition may be "configured to cause a first LLCR while mated with the ground conductors during operation" if the first LLCR increases by at least three times (3×) after an accelerated-aging protocol is applied. In certain embodiments, the ground-material composition may be "configured to cause a first LLCR while mated with the ground conductors during operation" if the first LLCR increases by at least ten times (10×) after the accelerated-aging protocol is applied. In more particular embodiments, the ground-material composition may be "configured to cause a first LLCR while mated with the ground conductors during operation" if the first LLCR increases by at least one fifty times (50×) after the accelerated-aging protocol is applied. In more particular embodiments, the ground-material composition may be "configured to cause a first LLCR while mated with the ground conductors during operation" if the first LLCR increases by at least one hundred times (100×) after the accelerated-aging protocol is applied.

The signal-material composition may be "configured to cause the second LLCR while mated with the signal conductors during operation" if the second LLCR increases by at most three times after the accelerated-aging protocol is applied. Accordingly, a material composition may be "configured to cause a [designated] LLCR while mated with the conductors during operation" if the designated LLCR increases by at least a designated amount or, alternatively, by at most a designated amount.

In some embodiments, the material compositions that plate the signal contacts and the ground contacts may have layers with different thicknesses. For example, the ground-material composition may include an outer layer that has a first thickness and the signal-material composition may include an outer layer that has a second thickness. The first thickness may be less than the second thickness. In such embodiments, the first thickness may be associated with a greater porosity and, hence, greater increase in contact resistance. Nonetheless, the LLCR may not increase beyond a designated maximum. By way of example, the first thickness may be less than 0.30 micrometers and the second thickness may be greater than 0.30 micrometers.

In some embodiments, the material compositions may include two or more layers that comprise the same materials but one or more layers may have a different thickness. For example, the signal contacts and the ground contacts may include an inner nickel layer and an outer gold layer. The thicknesses for the outer gold layers of the signal and ground contacts, however, may be different. For instance, the outer gold layer of the ground contacts may be a "flash" gold layer that is thinner than the outer gold layer of the signal contacts.

Yet in other embodiments, the material compositions may include two or more layers in which the outer layers have different materials. For example, the outer layer of the signal-material composition may include palladium-nickel (PdNi) and the outer layer of the ground-material composition may include gold (Au).

Although it is desirable that a plated layer have a uniform thickness along the respective electrical contact, this may be difficult to achieve. Accordingly, a thickness of the layer means an average thickness along the region where the two contacts engage each other. For example, if a claim recites "a thickness of at least 0.30 mm," the thickness of the layer where the two mated contacts engage each other should have an average thickness that is at least 0.30 mm. The average thickness may be determined using, for example, a scanning electron microscope (SEM).

In many cases, a plated layer will have pores through which an underlying material or other inner material will be exposed. Exposure of the underlying material through pores increases the likelihood of corrosion. The degree of porosity depends on a thickness of the layer, the method by which the layer was applied, a roughness of the underlying material, and a cleanliness of the underlying material. As the thickness of a layer increases, the likelihood that a pore will extend entirely through the layer to the underlying material decreases. But as the thickness decreases, the likelihood that a pore will extend entirely through the layer to the underlying material increases. Layers that are plated over underlying material with rough surfaces will typically have a greater porosity compared to layer that are plated over underlying material with smoother surfaces. Dirt or oxides along a surface of the underlying material is also associated with a greater number of pores.

Various testing standards may be used to measure LLCR. For example, one standard that may be used to measure LLCR includes Telcordia GR-1217-Core "Generic Requirements for Separable Electrical Connectors Used In Telecommunications Hardware." Unless stated otherwise in the claims, the LLCR is measured or determined in a manner consistent with Telcordia GR-1217-Core. Other standards may include EIA 364-23, MIL-STD-202, MIL-J-641, MIL-E-2036, MIL-STD-3885, or MIL-H-83511.

In particular embodiments, the electrical contacts provide signal pathways for transmitting data signals. Embodiments may be particularly suitable for communication systems, such as network systems, servers, data centers, and the like, in which the data rates may be greater than ten (10) gigabits/second (Gbps) or greater than five (5) gigahertz (GHz). One or more embodiments may be configured to transmit data at a rate of at least 20 Gbps, at least 40 Gbps, at least 56 Gbps, or more. One or more embodiments may be configured to transmit data at a frequency of at least 10 GHz, at least 20 GHz, at least 28 GHz, or more. As used herein with respect to data transfer, the term "configured to" does not mean mere capability in a hypothetical or theoretical sense, but means that the embodiment is designed to transmit data at the designated rate or frequency for an extended period of time (e.g., expected time periods for commercial use) and at a signal quality that is sufficient for its intended commercial use. It is contemplated, however, that other embodiments may be configured to operate at data rates that are less than 10 Gbps or operate at frequencies that are less than 5 GHz.

Various embodiments may be configured for certain applications. One or more embodiments may be configured for backplane or midplane communication systems. For example, one or more of the electrical connectors described herein may be similar to electrical connectors of the STRADA Whisper or Z-PACK TinMan product lines developed by TE Connectivity. The electrical connectors may include high-density arrays of electrical contacts. A high-density array may have, for example, at least 12 signal contacts per 100 mm2 along the mating side or the mounting side of the electrical connector. In more particular embodiments, the high-density array may have at least 20 signal contacts per 100 mm2. Non-limiting examples of some applications that may use embodiments set forth herein include host bus adapters (HBAs), redundant arrays of inexpensive disks (RAIDs), workstations, servers, storage racks, high performance computers, or switches. Embodiments may also include electrical connectors that are small-form factor connectors. For example, the electrical connectors may be configured to be compliant with certain standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard.

As used herein, phrases such as "a plurality of [elements]" and "a mating array of [elements]" and the like, when used in the detailed description and claims, do not necessarily include each and every element that a component may have. The component may have other elements that are similar to the plurality of elements. For example, the phrase "a plurality of ground contacts [being/having a recited feature]" does not necessarily mean that each and every ground contact of the component has the recited feature. Other ground contacts may not include the recited feature. Accordingly, unless explicitly stated otherwise (e.g., "each and every electrical contact of the electrical connector [being/having a recited feature]"), embodiments may include similar elements that do not have the recited features.

In order to distinguish similar elements in the detailed description and claims, various labels may be used. For example, an electrical connector may be referred to as a header connector, a receptacle connector, or a mating connector. Electrical contacts may be referred to as header contacts, receptacle contacts, mating contacts, signal contacts, or ground contacts. Signal contacts may be referred to as signal conductors. Ground contacts may be referred to as ground conductors. When similar elements are labeled differently (e.g., signal contacts and signal conductors), the different labels do not necessarily require structural differences.

FIG. 1 is a perspective view of an embodiment of an electrical connector assembly 10. The connector assembly 10 includes a receptacle connector 12 and a header connector 14 that are configured to mate together to establish an electrical connection between two circuit boards (not shown). The receptacle connector 12 and the header connector 14 include respective mating interfaces 16 and 18 at which the connectors 12 and 14 are configured to be mated together. The receptacle connector 12 and the header connector 14 may each be referred to herein as an "electrical connector".

The receptacle connector 12 is configured to be mounted to one of the circuit boards along a mounting interface 20 of the receptacle connector 12. Similarly, the header connector 14 is configured to be mounted to the other circuit board along a mounting interface 22 of the header connector 14. In the illustrated embodiment, the mounting interface 20 of the receptacle connector 12 is oriented approximately perpendicular to the mating interface 16 of the receptacle connector 12; and the mounting interface 22 of the header connector 14 is oriented approximately parallel to the mating interface 18 of the header connector 14. Accordingly, when the receptacle connector 12 is mated with the header connector 12, the circuit boards are orientated approximately perpendicular to each other, however, other orientations are possible in other embodiments.

Figure 2:
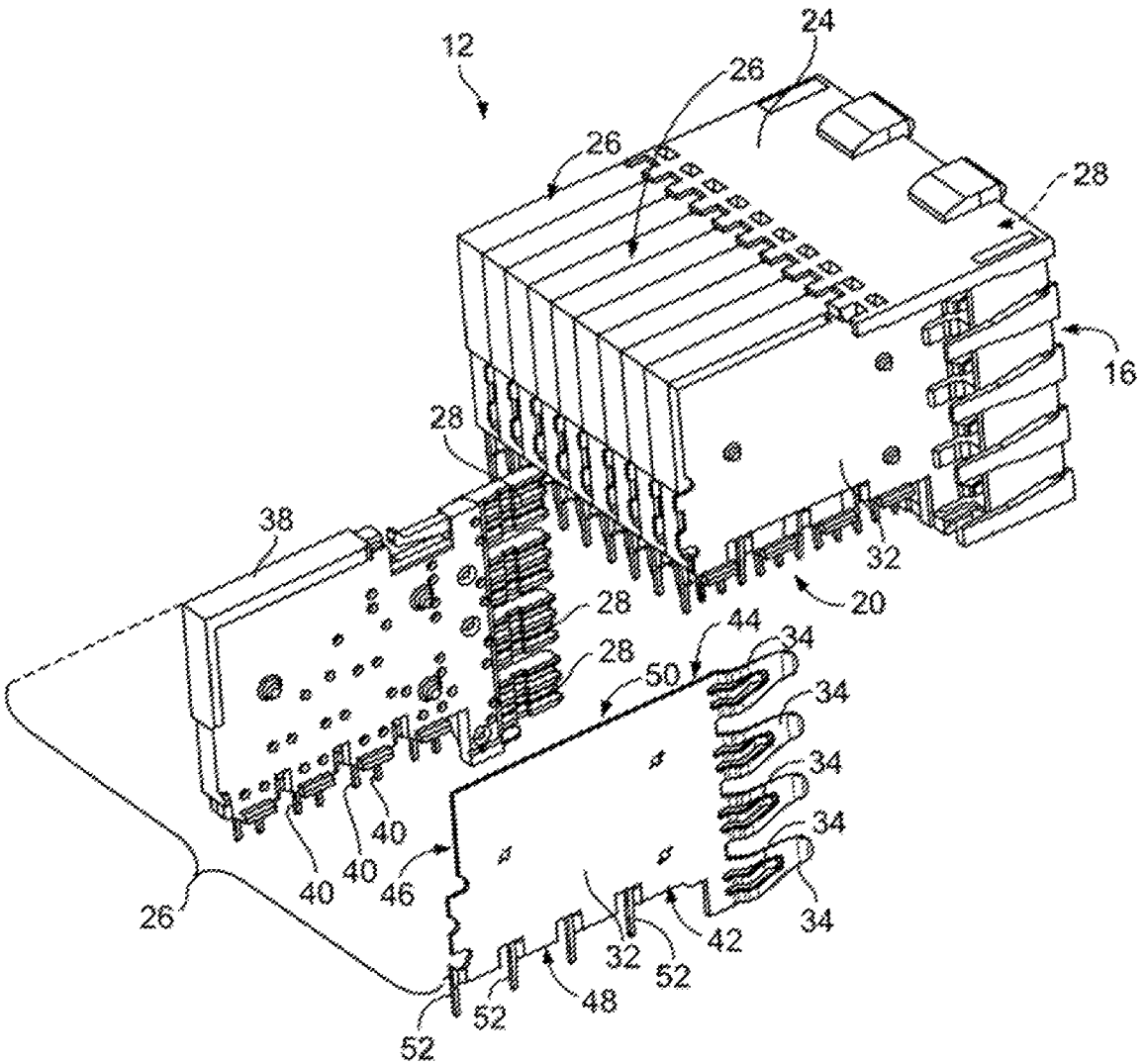
FIG. 2 is a partially exploded perspective view of an embodiment of a receptacle connector of the electrical connector system shown in FIG. 1.

FIG. 2 is a partially exploded perspective view of an embodiment of the receptacle connector 12. The receptacle connector 12 includes a housing 24 that holds a plurality of contact modules 26. The contact modules 26 are held in a stacked configuration generally parallel to one another. The contact modules 26 hold a plurality of signal contacts 28 that extend along the mating interface 16 for mating with corresponding mating signal contacts 30 (shown in FIGS. 1, 3, 5, and 6) of the header connector 14 (shown in FIGS. 1, 3, 4, and 5). Optionally, the signal contacts 28 are arranged in pairs carrying differential signals, as is shown in the illustrated embodiment. In the illustrated embodiment, the contact modules 26 are oriented generally along vertical planes. But, other orientations are possible in other embodiments. For example, in some embodiments, the contact modules 26 are oriented generally along horizontal planes.

The housing 24 is manufactured from a dielectric material, such as, but not limited to, a plastic material and/or the like. The housing 24 includes a plurality of signal contact openings (not shown) and a plurality of ground contact openings (not shown) extending along the mating interface 16. The contact modules 26 are mounted to the housing 24 such that the signal contacts 28 are received in corresponding signal contact openings. When received within the corresponding signal contact openings, the signal contacts 28 define a portion of the mating interface 16 of the receptacle connector 12. Optionally, a single signal contact 28 is received in each signal contact opening. The signal contact openings also receive corresponding mating signal contacts of the header connector 14 when the receptacle connector 12 is mated with the header connector 14.

The signal contact openings, and thus the signal contacts 28, may be arranged in any pattern. In the illustrated embodiment, the signal contact openings are arranged in an array of rows and columns. The columns are oriented generally vertically and the rows are oriented generally horizontally; however, other orientations are possible in other embodiments. In the illustrated embodiment, the signal contacts 28 within each differential pair are arranged in a same column, and thus the receptacle connector 12 defines a pair-in-column receptacle connector. In other embodiments, the signal contacts 28 within each differential pair are arranged in the same row such that the receptacle connector 12 defines a pair-in-row receptacle connector.

Each contact module 26 includes a dielectric carrier 38 that holds an array of conductors. The carrier 38 may be overmolded over the array of conductors, though additionally or alternatively other manufacturing processes may be utilized to form the carrier 38. Optionally, the array of conductors is stamped and formed as an integral leadframe prior to overmolding of the carrier 38. Portions of the leadframe that connect the conductors are removed after the overmolding to provide individual conductors in the array held by the carrier 38. In addition or alternatively, other manufacturing processes are used to form the conductor array.

The conductor array includes the signal contacts 28, a plurality of mounting contacts 40, and leads (not shown) that connect the signal contacts 28 to the corresponding mounting contacts 40. The signal contacts 28, the leads, and the mounting contacts 40 define signal paths through the contact module 26. In the illustrated embodiment, the signal contacts 28 include receptacle-type mating ends having a receptacle that is configured to receive a pin-type contact 30 of the header connector 14. Other types, structures, and/or the like of signal contacts 28 may be provided in other embodiments.

The mounting contacts 40 are configured to be mounted to the corresponding circuit board in electrical contact therewith to electrically connect the signal contacts 28 to the circuit board. When the contact module 26 is mounted to the housing 24 of the receptacle connector 12, the mounting contacts 40 extend along (and define a portion of) the mounting interface 20 of the receptacle connector 12 for mounting the receptacle connector 12 to the circuit board. In the illustrated embodiment, the mounting contacts 40 are compliant eye-of-the needle (EON) pins, but any other type, structure, and/or the like of contact may additionally or alternatively be used to mount the receptacle connector 12 to the circuit board, such as, but not limited to, a different type of compliant pin, a solder tail, a surface mount structure, and/or the like.

The contact modules 26 include ground shields 32 that provide impedance control along the signal path and/or electrical shielding for the signal contacts 28 from electromagnetic interference (EMI) and/or radio frequency interference (RFI). The ground shields 32 include ground contacts 34 that are configured to mate with corresponding mating ground shields 36 (shown in FIGS. 1 and 3-6) of the header connector 14. The contact modules 26 are mounted to the housing 24 such that the ground contacts 34 are received in corresponding ground contact openings. Optionally, a single ground contact 34 is received in each ground contact opening. The ground contact openings also receive the corresponding mating ground shields 36 of the header connector 14 therein when the receptacle connector 12 is mated with the header connector 14. As shown, the header connector 14 includes a mating array 21. The mating array 21 is a designated arrangement of a plurality of the signal contacts 30 and a plurality of the ground contacts 36. The signal and ground contacts 30, 36 are coupled (directly or indirectly) to a housing 54 of the header connector 14.

Each ground shield 32 includes a body 42 that extends a length from a front end 44 to a rear end 46. The body 42 also extends from a mounting end 48 to an opposite end 50. The body 42 of the ground shield 32 is electrically conductive and is configured to provide impedance control and/or shield the signal contacts 28 from electromagnetic interference (EMI) and/or radio frequency interference (RFI). Specifically, the body 42 extends over at least a portion of the corresponding conductor array of the contact module 26 when the body 42 is mounted to the corresponding carrier 38.

The ground shield 32 includes mounting contacts 52, which extend along the mounting end 48 and are configured to be mounted to the corresponding circuit board in electrical contact therewith to electrically connect the ground shield 32 to a ground plane (not shown) of the circuit board. When the contact module 26 that includes the ground shield 32 is mounted to the housing 24 of the receptacle connector 12, the mounting contacts 52 extend along (and define a portion of) the mounting interface 20 of the receptacle connector 12 for mounting the receptacle connector 12 to the circuit board. In the illustrated embodiment, the mounting contacts 52 are compliant eye-of-the needle (EON) pins. But, additionally or alternatively, any other type, structure, and/or the like of contact may be used to mount the receptacle connector 12 to the circuit board, such as, but not limited to, a different type of compliant pin, a solder tail, a surface mount structure, and/or the like.

The ground contacts 34 extend along the front end 44 of the body 42 of the ground shield 32. As should be apparent from FIG. 2 and the description herein, the ground contacts 34 are electrically connected together by the body 42 of the ground shield 32 in the illustrated embodiment. But, alternatively the ground contacts 34 are not electrically connected together. When the ground shield 32 is mounted to the corresponding carrier 38 of the corresponding contact module 26, the ground contacts 34 define a portion of the mating interface 16 of the receptacle connector 12. In the illustrated embodiment, the ground contacts 34 include spring beams. Other types, structures, and/or the like of the ground contacts 34 may be provided in other embodiments.

Figure 3:
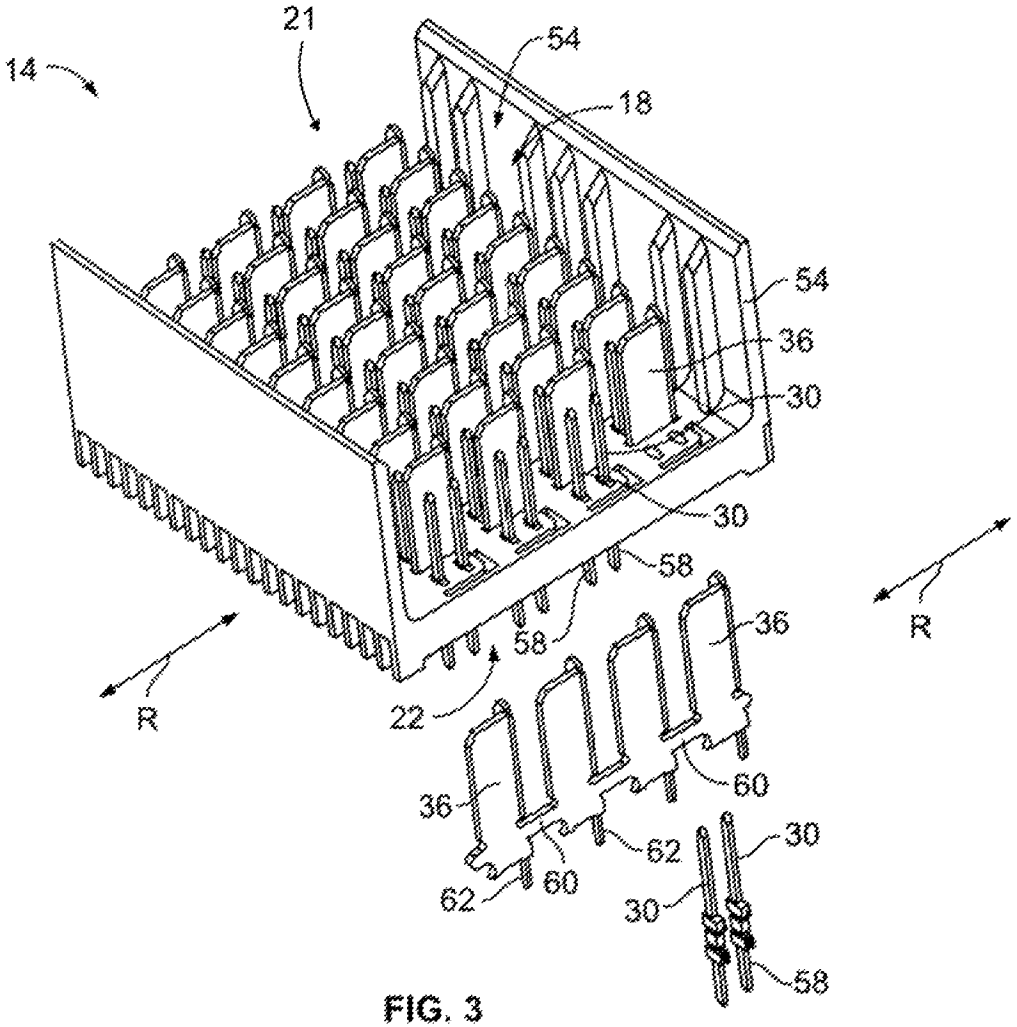
FIG. 3 is a partially exploded perspective view of an embodiment of a header connector of the electrical connector system shown in FIG. 1.

FIG. 3 is a partially exploded perspective view of an embodiment of the header connector 14. The header connector 14 includes a housing 54 that holds the signal contacts 30 and the ground shields 36 of the header connector 14. The housing 54 is manufactured from a dielectric material, such as, but not limited to, a plastic material and/or the like. In the illustrated embodiment, the housing 54 of the header connector 14 includes a receptacle 56 that receives a portion of the housing 24 (shown in FIG. 2) of the receptacle connector 12 (shown in FIGS. 1, 2, 4, and 5) therein when the connectors 12 and 14 are mated together.

As shown in FIG. 3, the signal contacts 30 extend along the mating interface 18 of the header connector 14 for mating with the corresponding mating signal contacts 28 (shown in FIGS. 2 and 5) of the receptacle connector 12. Optionally, the signal contacts 30 are arranged in pairs carrying differential signals, as is shown in the illustrated embodiment. The signal contacts 30 may be arranged in any pattern. In the illustrated embodiment, the signal contacts 30 are arranged in an array of rows and columns; however, other orientations are possible in other embodiments. In the illustrated embodiment, the signal contacts 30 include pins; however, other types, structures, and/or the like of signal contacts 30 may be provided in other embodiments.

The signal contacts 30 of the header connector 14 include signal mounting ends 58 that extend along (and define a portion of) the mounting interface 22 of the header connector 14 for mounting the header connector 14 to the corresponding circuit board. Specifically, the signal mounting ends 58 are configured to be mounted to the corresponding circuit board in electrical contact therewith to electrically connect the signal contacts 30 to the circuit board. In the illustrated embodiment, the signal mounting ends 58 are compliant eye-of-the needle (EON) pins, but any other type, structure, and/or the like of contact may additionally or alternatively be used to mount the header connector 14 to the circuit board, such as, but not limited to, a different type of compliant pin, a solder tail, a surface mount structure, and/or the like.

The ground shields 36 of the header connector 14 provide impedance control and/or electrical shielding for the signal contacts 30 from EMI and/or RFI. Specifically, the ground shields 36 extend around at least a portion of corresponding signal contacts 30 (corresponding differential pairs in the illustrated embodiment) of the header connector 14. The ground shields 36 extend along (and define a portion of) the mating interface 18 of the header connector 14 for mating with the corresponding ground contacts 34 (shown in FIGS. 2, 4, and 5) of the receptacle connector 12. In the illustrated embodiment, the ground shields 36 create a commoned (i.e., electrically connected) ground structure between the connectors 12 and 14. As should be apparent from FIG. 3 and the description herein, in the illustrated embodiment, the ground shields 36 are electrically connected together with at least some adjacent ground shields 36 by electrical bridges 60. In the illustrated embodiment, the ground shields 36 within the same row R are electrically connected together. But, alternatively the ground shields 36 are not electrically connected together. The ground shields 36 include blade structures in the illustrated embodiment; however, other types, structures, and/or the like of the ground shields 36 may be provided in other embodiments. The ground shields 36 may be referred to herein as "ground contacts" or "ground conductors" (e.g., the ground shields 36 may be referred to herein as "ground contacts" or "ground conductors" in the Claims of this application).

The ground shields 36 of the header connector 14 include ground mounting ends 62 that extend along (and define a portion of) the mounting interface 22 of the header connector 14 for mounting the header connector 14 to the corresponding circuit board. Specifically, the ground mounting ends 62 are configured to be mounted to the corresponding circuit board in electrical contact therewith to electrically connect the ground shields 36 to a ground plane (not shown) of the circuit board. In the illustrated embodiment, the ground mounting ends 62 are compliant eye-of-the needle (EON) pins, but any other type, structure, and/or the like of contact may additionally or alternatively be used to mount the header connector 14 to the circuit board, such as, but not limited to, a different type of compliant pin, a solder tail, a surface mount structure, and/or the like.

FIG. 4 is an elevational view of a portion of the receptacle connector 12 and a portion of the header connector 14 illustrating the connectors 12 and 14 mated together. As shown in FIG. 4, the ground contacts 34 of the receptacle connector 12 are mated with the corresponding ground shields 36 of the header connector 14. As described above, in the illustrated embodiment, the ground contacts 34 of the receptacle connector 12 that are shown in FIG. 4 are electrically connected together by the body 42 of the ground shield 32 shown in FIG. 4. Moreover, in the illustrated embodiment, the ground shields 36 of the header connector 14 that are shown in FIG. 4 are electrically connected together by the electrical bridges 60 shown in FIG. 4. Accordingly, the mated ground contacts 34 and ground shields 36 shown in FIG. 4 define four parallel resistance paths $P_1$-$P_4$.

Referring again to FIGS. 2 and 3, the signal contacts 28 (not shown in FIG. 3) of the receptacle connector 12 (not shown in FIG. 3) and the signal contacts 30 (not shown in FIG. 2) of the header connector 14 (not shown in FIG. 2) are plated with one or more materials to improve the electrical performance and/or mechanical reliability of the signal contacts 28 and 30. For example, the signal contacts 28 and/or 30 may be plated with one or more materials that provide the signal contacts 28 and/or 30 with a lower contact resistance and/or with one or more materials that increase the durability of the signal contacts 28 and/or 30 to thereby reduce the wear generated from repeated mating and de-mating of the connectors 12 and 14. Providing the signal contacts 28 and/or 30 with a lower contact resistance may include, but is not limited to, plating the signal contacts 28 and 30 with a material with a relatively high electrical conductivity and relatively low electrical resistance, with a material that resists, inhibits, and/or reduces corrosion, and/or the like. Increasing the durability of the signal contacts 28 and/or 30 may include, but is not limited to, plating the signal contacts 28 and/or 30 with a material with a relatively high hardness, with a material that resists, inhibits, and/or reduces corrosion, and/or the like.

The signal contacts 28 and 30 may be fabricated from any base material, such as, but not limited to, copper, a copper alloy, and/or the like. The signal contacts 28 and 30 may include any number of layers of plating on the base material. Each layer of plating may have any thickness, which may be selected to provide the particular signal contact 28 or 30 with one or more electrical and/or mechanical properties (such as, but not limited to, durability, conductance, resistance, impedance, resilience, and/or the like). Examples of materials that may be plated on the signal contacts 28 and 30 include, but are not limited to, precious metals, precious metal alloys, nickel (Ni), nickel alloys, gold (Au), gold alloys, palladium (Pd), palladium alloys, palladium-nickel (PdNi), materials that inhibits, resists, and/or reduces corrosion, materials with a relatively high electrical conductivity and relatively low electrical resistance, materials with a relatively high hardness, and/or the like.

Examples of materials with which the signal contacts 28 and 30 may be plated to reduce the contact resistance of the signal contacts 28 and 30 include, but are not limited to, precious metals, precious metal alloys, gold (Au), gold alloys, palladium (Pd), palladium alloys, palladium-nickel (PdNi), materials that inhibits, resists, and/or reduces corrosion, materials with a relatively high electrical conductivity and relatively low electrical resistance, and/or the like.

Examples of materials with which the signal contacts 28 and 30 may be plated to increase the durability of the signal contacts 28 an 30 include, but are not limited to, precious metals, precious metal alloys, nickel (Ni), nickel alloys, gold (Au), gold alloys, palladium (Pd), palladium alloys, palladium-nickel (PdNi), materials that inhibits, resists, and/or reduces corrosion, materials with a relatively high hardness, and/or the like.

The ground contacts 34 (not shown in FIG. 3) of the receptacle connector 12 and the ground shields 36 (not shown in FIG. 2) of the header connector 14 may be plated with one or more materials, for example to improve the electrical performance and/or mechanical reliability of the ground contacts 34 and the ground shields 36. In some embodiments, the ground contacts 34 and/or the ground shields 36 are not plated with any materials (i.e., no plating is deposited on the base material of the ground contacts 34 and/or the ground shields 36), as will be briefly discussed below.

The ground contacts 34 and the ground shields 36 have different plating as compared to the signal contacts 28 and 30. Specifically, the plating of the signal contacts 28 and 30 may include at least one material that is different from any of the plating materials of the ground contacts 34 and the ground shields 36. In other words, in some embodiments, the plating of the ground contacts 34 and the ground shields 36 lacks one or more of the materials contained within the plating of the signal contacts 28 and 30. In addition or alternative to lacking one or more materials of the signal contact plating, the plating of the ground contacts 34 and the ground shields 36 may be different by including less of one or more materials contained within the plating of the signal contacts 28 and 30. For example, the plating of the ground contacts 34 and the ground shields 36 may include a layer of material that is thinner than the corresponding layer of material of the signal contact plating, and/or the ground contact plating may include fewer layers of a particular material as compared to the signal contact plating.

The ground contacts 34 and the ground shields 36 may have any number of layers of plating on the base material thereof, which may be greater than, equal to, or less than the number of layers of the plating of the signal contacts 28 and 30. In some embodiments, the ground contacts 34 and the ground shields 36 are not plated such that the ground contacts 34 and the ground shields 36 have zero layers of plating on the base material thereof.

Figure 5:
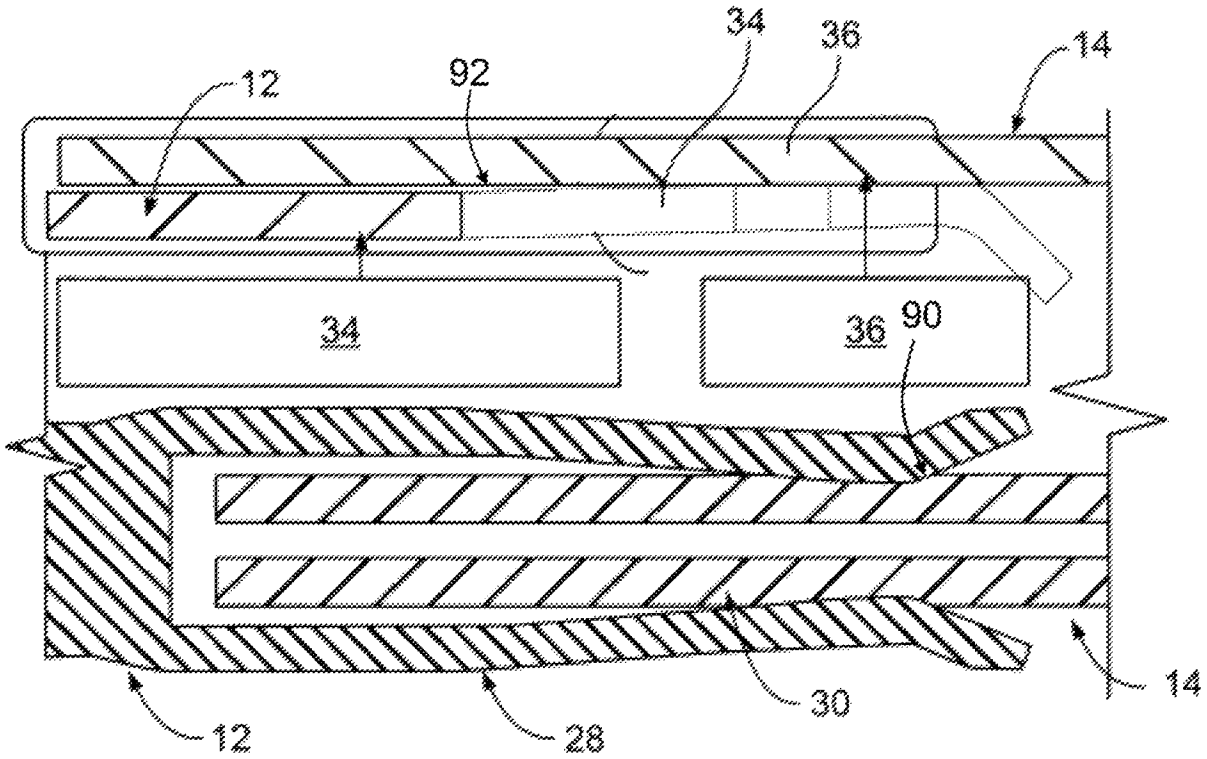
FIG. 5 is a cross-sectional view also illustrating the receptacle and header connectors mated together.

In the embodiments described and illustrated herein, the plating of the ground contacts 34 and the ground shields 36 is different from the plating of the signal contacts 28 and 30 by lacking (and/or including a lesser amount of) one or more materials that are selected to provide the signal contacts 28 and 30 with a lower contact resistance (such as, but not limited to, a material that reduces rust, corrosion, oxidation, another chemical process, and/or the like). In other words, the at least one plating material of the signal contacts 28 and 30 that is different from the plating materials of the ground contacts 34 and the ground shields 36 is a material that provides a reduced contact resistance. For example, as shown in FIG. 5, the ground contacts 34 (e.g., having a plated ground-material composition) and the ground shields 36 mate with each other at respective ground interfaces 92, and the signal contacts 28 (e.g., having a plated signal-material composition) and the signal contacts 30 mate with each other at respective signal interfaces 90. Accordingly, the ground contacts 34 and the ground shields 36 have a higher contact resistance as compared to the signal contacts 28 and 30, for example because of rust, corrosion, oxidation, another chemical process, and/or the like resulting from exposure of the ground contacts 34 and/or the ground shields 36 to the environment. For example, the signal contacts 28 and 30 may have a contact resistance of equal to or less than 10 milliohms, while the ground contacts 34 and the ground shields 36 may have a contact resistance from approximately 20 milliohms to approximately 1 ohm.

The higher contact resistance of the ground contacts 34 and the ground shields 36 may not adversely affect the electrical performance of the connectors 12 and 14 at relatively high frequencies (e.g., at frequencies of at least 10 Gigabits). At relatively high frequencies, the magnitude of electrical resistance depends on, for example, interface dimensions, plating materials, dielectric materials, surface roughness, skin effect, and/or the like. It should be understood that the impedance of an electrical interface at relatively high frequency is determined not only by direct current (DC) contact resistance, but also by capacitive and inductive coupling mechanisms. For example, because of the parallel resistance paths $P_1$-$P_4$ (described above) defined by the ground contacts 34 and the ground shields 36, the ground contact resistance will be reduced according to the parallel resistor equation. Specifically, the parallel ground resistance circuit of the parallel resistance paths $P_1$-$P_4$ will lower the effect of any single relatively high resistance value at individual ground interfaces (i.e., an individual interface of a ground contact 34 and the corresponding ground shield 36, such as the ground interface 92 described below with reference to FIG. 5).

Additionally, and for example, FIG. 5 is a cross-sectional view of a portion of the receptacle connector 12 and a portion of the header connector 14 illustrating the connectors 12 and 14 mated together. Specifically, FIG. 5 illustrates a ground contact 34 of the receptacle connector 12 mated with the corresponding ground shield 36 of the header connector 14 at a ground interface 92. As can be seen in FIG. 5, the ground contacts 34 and the ground shields 36 mate together at the ground interface 92 with a relatively shallow (e.g., less than approximately 5°) angle of attack $\alpha$, which may increase the capacitive coupling mechanism between the ground contacts 34 and the ground shields 36. Specifically, the relatively shallow angle of attack $\alpha$ between the ground contacts 34 and the ground shields 36 may create a higher capacitance value and therefore a lower resistance value. Moreover, a relatively shallow angle of attack $\alpha$ combined with a plurality of the ground contacts 34 and/or ground shields 36 arranged in parallel resistance paths may further lower the contact resistance of the ground interfaces 100.

As described above, the higher contact resistance of the ground contacts 34 and the ground shields 36 may not adversely affect the electrical performance of the connectors 12 and 14 at relatively high frequencies. Specifically, the higher contact resistance of the ground contacts 34 and the ground shields 36 as compared to the signal contacts 28 and 30 may not lower the transmission speed of the connectors 12 and 14. For example, the higher contact resistance of the ground contacts 34 and the ground shields 36 may not inhibit the ability of the connectors 12 and 14 to reliably transmit signals at a rate of at least 10 Gigabits.

Eliminating or reducing plating materials that are selected to provide a lower contact resistance may reduce the cost of plating the ground contacts 34 and the ground shields 36, which may thereby reduce the cost of manufacturing the connectors 12 and 14. For example, plating materials that provide lower contact resistance often include precious metals, which are relatively expensive. Eliminating or reducing the amount of one or more precious metals of the plating of the ground contacts 34 and the ground shields 36 may significantly reduce the cost of such plating. Moreover, embodiments that reduce the number of layers of the ground contact plating may lower the cost of the plating process used to plate the ground contacts 34 and the ground shields 36.

The ground contacts 34 and the ground shields 36 may be fabricated from any base material, such as, but not limited to, copper, a copper alloy, stainless steel, silver-nickel (AgNi), and/or the like. Each layer of plating of the ground contacts 34 and the ground shields 36 may have any thickness, which may be selected to provide the particular ground contact 34 or ground shield 36 with one or more electrical and/or mechanical properties (such as, but not limited to, durability, conductance, resistance, impedance, resilience, and/or the like).

Examples of materials that may be plated on the ground contacts 34 and the ground shield 36 include, but are not limited to, precious metals, precious metal alloys, gold, gold alloys, palladium, palladium alloys, dilute palladium-nickel, nickel alloys, nickel-phosphorus (NiP), nickel sulfamate ($Ni(SO_3NH_2)_2$), nickel-tungsten (NiW), structured nickel, cobalt-phosphorus (CoP), chromium (Cr), copper (Cu), zinc (Zn), zinc-nickel (ZnNi), zinc with steel, carbon, a carbon ink, a carbon epoxy, and/or the like. In certain embodiments, the ground-material composition may include nickel sulfamate ($Ni(SO_3NH_2)_2$), tin-nickel (Sn/Ni), nickel-phosphorus (NiP), nickel-tungsten (NiW), structured nickel, cobalt-phosphorus (CoP), dilute palladium-nickel (PdNi), chromium (Cr), zinc (Zn), zinc-nickel (ZnNi), zinc with steel, carbon, a carbon ink, or a carbon epoxy. In particular embodiments, the ground-material composition may include tin-nickel (Sn/Ni). Optionally, the ground-material composition may consist of or consist essentially of tin-nickel (Sn/Ni).

FIG. 6 illustrates an embodiment of the different plating of the ground contacts 34 (shown in FIGS. 2, 4, and 5) and the ground shields 36 as compared to the signal contacts 28 (shown in FIGS. 2 and 5) and the signal contacts 30. Specifically, FIG. 6 is a cross-sectional view illustrating one non-limiting example of different plating of a ground shield 36 and a signal contact 30.

The signal contact 30 includes a base material 70 and three layers of plating 72 on the base material 70. Specifically, the plating 72 of the signal contact 30 includes a base layer 72*a* of nickel, an intermediate layer 72*b* of palladium-nickel, and an outer layer 72*c* of gold. The palladium-nickel intermediate layer 72*b* facilitates reducing the contact resistance of the signal contact 30.

The ground shield 36 includes a base material 80 and two layers of plating 82 on the base material 80. Specifically, the plating 82 of the ground shield 36 includes a base layer 82*a* of nickel and an outer layer 82*c* of gold. The ground shield plating 82 does not include the palladium-nickel intermediate layer 72*b* of the signal contact plating 72. Accordingly, the ground shield 36 has a higher contact resistance as compared to the signal contact 30 but uses less plating material (e.g., less of the relatively-expensive precious metal palladium) and is therefore less expensive to plate.

Other non-limiting examples of embodiments of the plating configuration for the ground contacts 34 and the ground shield 36 include, but are not limited to: base material with a layer of nickel-phosphorus plating, base material with a layer of nickel-tungsten plating, base material with a layer of structured nickel plating, base material with a layer of pure nickel plating, base material with a layer of cobalt-phosphorus plating, base material with a layer of dilute palladium-nickel, base material with a layer of chromium (non-hex) plating, a base material of stainless steel with no plating, a base material of silver-nickel with no plating, plating that includes a passivated layer of copper or a copper alloy, base material with a layer of zinc-nickel plating, an exposed base material with a sacrificial area of plating material (such as, but not limited to, zinc with steel), base material with a carbon based layer of plating, base material with a layer of carbon ink or epoxy, and/or the like.

Although described and illustrated herein with respect to the connectors 12 and 14, the embodiments described and/or illustrated herein are not limited to such electrical connectors, but rather may be used with any other type of electrical connector, such as, but not limited to, cable connectors, other types of circuit board connectors, and/or the like.

The embodiments described and/or illustrated herein may reduce the cost of plating ground contacts without sacrificing electrical performance of an electrical connector that includes the ground contacts. The embodiments described and/or illustrated herein may provide an electrical connector that is less expensive to manufacture for a given electrical performance.

As used herein, a "ground contact" may include any structure, type, and/or the like of ground conductor, such as, but not limited to, a ground shield for a contact module (e.g., the ground shields 32 shown in FIGS. 2 and 4), a spring beam (e.g., the ground contacts 34 shown in FIGS. 2, 4, and 5), a blade structure (e.g., the ground shields 36 shown in FIGS. 1 and 3-6), a pin structure (e.g., the pin structure of the signal contacts 30 shown in FIGS. 1, 3, 5, and 6), a compliant pin structure (e.g., a compliant EON pin such as, but not limited to, the pins 40, 52, 58, and/or 62 described and illustrated herein), a solder tail structure, a surface mount structure, and/or the like.

Figure 7:
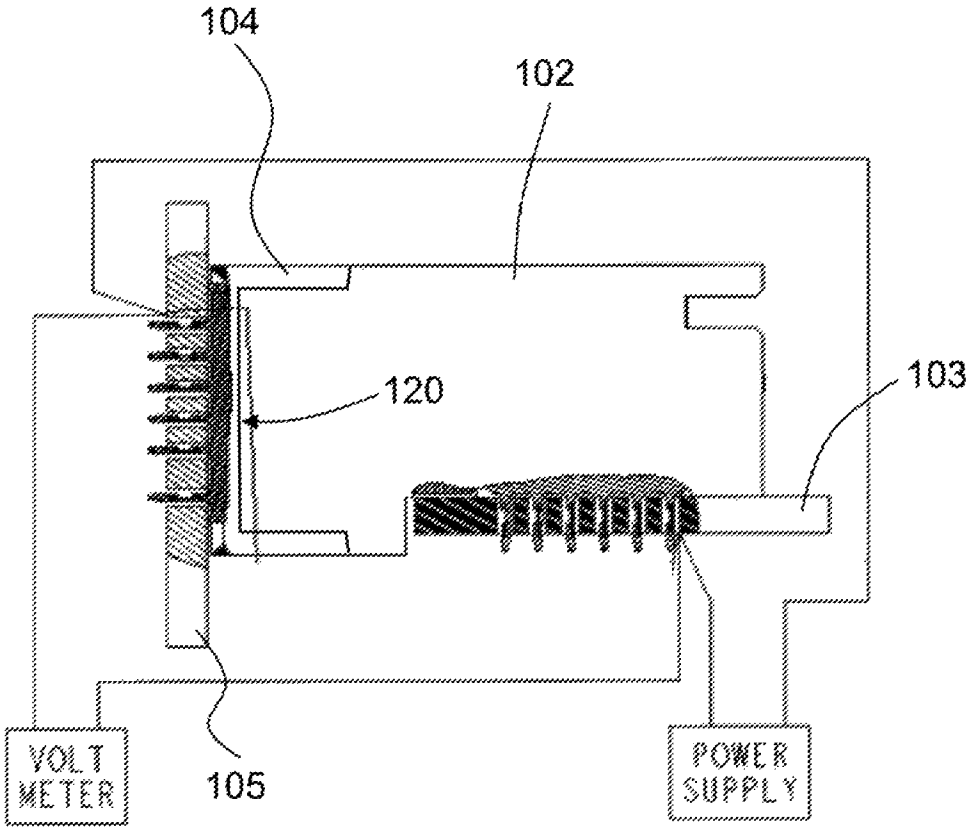
FIG. 7 is a side view of a communication system in accordance with an embodiment during low-level contact resistance (LLCR) measurement testing.

FIG. 7 is a side view of an electrical connector assembly 100 in accordance with an embodiment during low-level contact resistance (LLCR) measurement testing. The electrical connector assembly 100 includes an electrical connector 102 (referred to hereinafter as a receptacle connector) and an electrical connector 104 (referred to hereinafter as a header connector) that are mated to each other, thereby establishing an electrical connection between circuit boards 103, 105. The receptacle connector 102 is mounted to the circuit board 103, and the header connector 104 is mounted to the circuit board 105. The receptacle connector 102 and the header connector 104 include respective mating interfaces 106 and 108 at which the connectors 102 and 104 are mated together.

The receptacle connector 102 is mated to the header connector 104 along an interface 120. The receptacle connector 102 and the header connector 104 engage each other at multiple interfaces (not shown), each of which exists between an electrical contact of the header connector 104 and an electrical contact of the receptacle connector 102. Each of these interfaces may have an associated LLCR. As shown, the electrical connector assembly 100 is operably coupled to a voltage/current source (or power supply) 122 and a volt meter 124. The volt meter 124 may be a nanovoltmeter (e.g., Keithley 182 Sensitive DVM nanovoltmeter). The voltage/current source may be, for example, a Keithley 238 Source-Measure Unit. The test may be conducted according to, for example, EIA-364-23. Unless recited otherwise in the claims, LLCR is determined in accordance with EIA-364-23.

As shown in FIG. 7, the voltage/current source 122 and a volt meter 124 are electrically coupled to different contact points. The voltage/current source 122 is electrically coupled to plated thru-holes (PTHs) 123, 125 of the circuit boards 103, 105, respectively. The volt meter 124 may be electrically coupled to the same plated thru-holes and/or different points along the signal line. In the setup of FIG. 7, the signal through each signal line may be transmitted through multiple interfaces. As such, any LLCR measurements will represent a cumulative LLCR through multiple interfaces. In other embodiments, however, the volt meter 124 may be coupled to points along the signal line such that only one interface exists between the two points.

Figure 8:
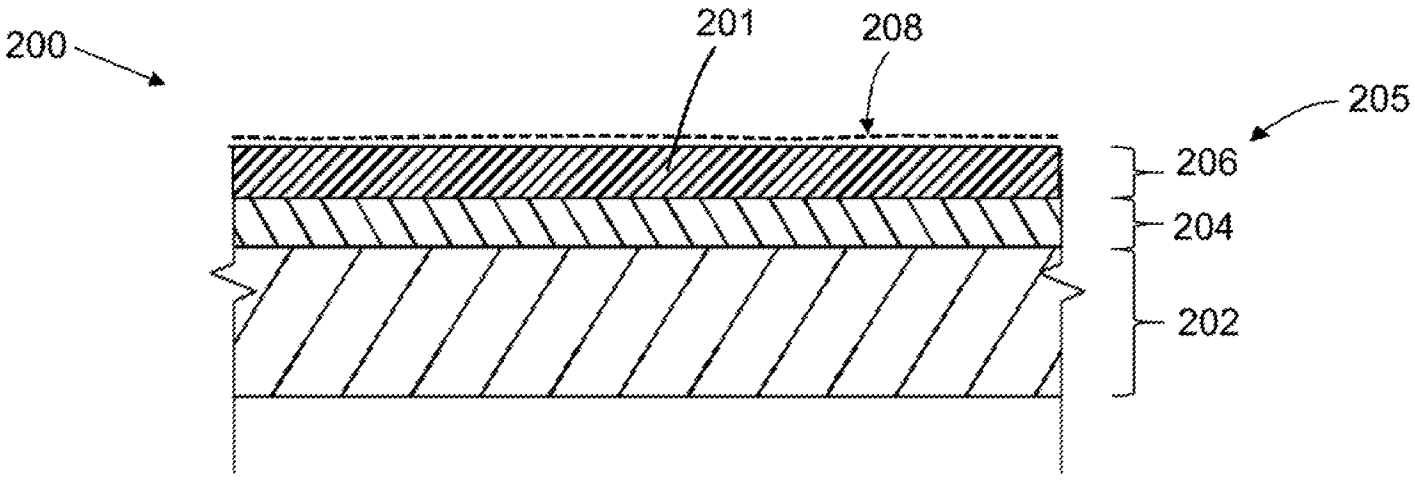
FIG. 8 illustrates a cross-section of a portion of a signal contact formed in accordance with an embodiment.

FIG. 8 illustrates a cross-section of a mating portion 201 of a signal contact 200 formed in accordance with an embodiment. The mating portion 201 represents the region of the signal contact 200 that directly engages another electrical contact (not shown). As shown, the signal contact 200 includes a base layer (or base material) 202, an intermediate or barrier layer 204 that is plated over the base layer 202, and a plated layer 206 that is plated over the intermediate layer 204. The base layer 202 may be, for example, a copper or copper alloy (e.g., beryllium copper). The intermediate layer 204 may include nickel and/or tin and may function as a diffusion barrier between the base layer 202 and subsequent layer(s). In some embodiments, the plated layer 206 comprises palladium-nickel. Alternatively, the plated layer 206 may be another precious metal material (e.g., gold alloy or silver alloy). The plated layer 206 may have a thickness that exceeds, for example, 30 microinches or 762 nanometers. The intermediate and the plated layers 204, 206 may be referred to collectively as a signal-material composition 205.

Optionally, a pore-blocking substance 208 may be coated onto the plated layer 206 such that the pore-blocking substance 208 is deposited within any pores of the plated layer 206. Various methods may be used to apply the pore-blocking substance, such as spraying, brushing, dipping, and the like. The pore-blocking substance 208 is configured to reduce corrosion along an exterior surface of the electrical contact. In some cases, the pore-blocking substance 208 may also function as or be substituted with a lubricant. Examples of pore-blocking substances that may be used with embodiments described herein include at least one of a polysiloxane (e.g. dimethyl polysiloxane, phenylmethyl polysiloxane), silicate ester, polychlorotrifluoro-ethylene, di-ester, fluorinated ester, glycol, chlorinated hydrocarbon, phosphate ester, polyphenyl ether, perfluoroalkyl polyether, poly-alpha-olefin, petroleum oil, organometallic compound, benzotriazole (BTA), mercaptobenzotriazole, self-assembled monolayer (SAM), or microcrystalline wax. Proprietary pore-blocking substances may also be used, such as D-5026NS/ZC-026 by Zip-Chem.

Figure 9:
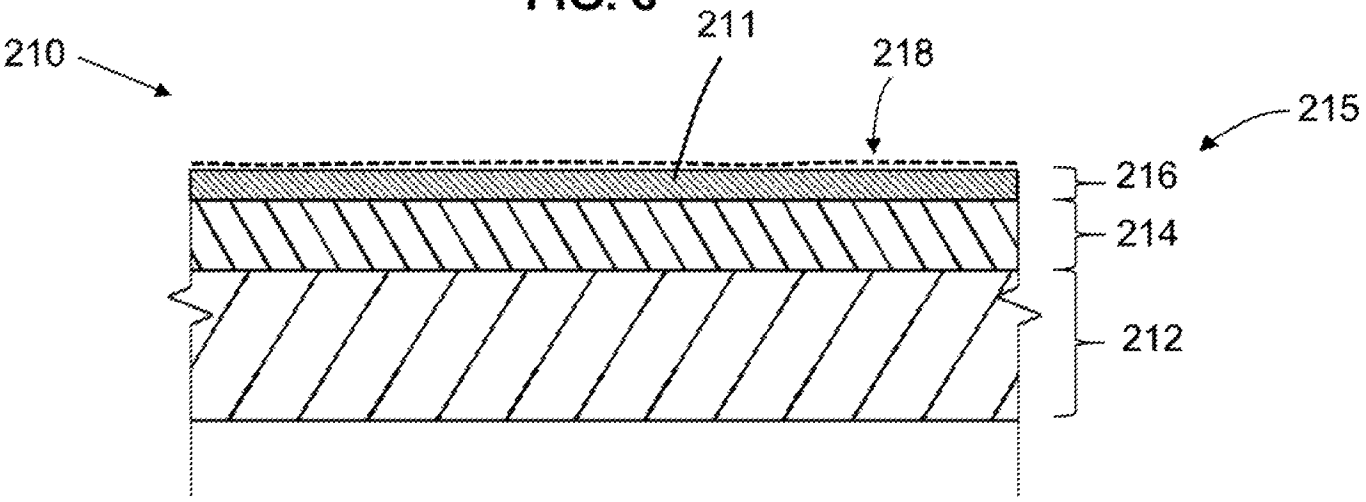
FIG. 9 illustrates a cross-section of a portion of a signal contact formed in accordance with an embodiment.

FIG. 9 illustrates a cross-section of a mating portion 211 of a ground contact 210 formed in accordance with an embodiment. The mating portion 211 represents the region of the ground contact 210 that directly engages another electrical contact. As shown, the ground contact 210 includes a base layer (or base material) 212, an intermediate or barrier layer 214 that is plated over the base layer 212, and a plated layer 216 that is plated over the intermediate layer 214. The base layer 212 may be, for example, a copper or copper alloy (e.g., beryllium copper). The intermediate layer 214 may include nickel and/or tin and may function as a diffusion barrier between the base layer 212 and subsequent layer(s). In some embodiments, the plated layer 216 comprise gold (e.g., gold alloy). The intermediate and the plated layers 214, 216 may be referred to collectively as a ground-material composition 215.

In particular embodiments, the plated layer 216 is a flash layer. For example, a flash layer may include gold alloy, silver alloy, palladium, or palladium alloy and may be from about 2 to about 30 microinches (or about 50.8 nm to about 762 nm) depending upon the material. If the flash layer includes gold, the thickness may be from about 2 to about 12 microinches (or about 50.8 nm to about 304 nm). A flash layer comprising silver or silver alloy may be from about 2 to about 30 microinches (or about 50.8 nm to about 762 nm).

Optionally, a pore-blocking substance 218 may be coated onto the plated layer 216 such that the pore-blocking substance 218 is deposited within any pores of the plated layer 216. Various methods and pore-blocking substances, such as those described above, may be used.

Accordingly, as illustrated in FIGS. 8 and 9, the signal contact 200 and the ground contact 210 may have the same layers (e.g., base layer, intermediate layer, and plated layer) but with different materials. Specifically, the plated layers 206 and 216 comprise palladium-nickel and gold alloy, respectively. Accordingly, less expensive material may be used for making the plated layer 216 for the ground contacts 210 compared to the plated layer 206 for the signal contacts 200.

Figure 10:
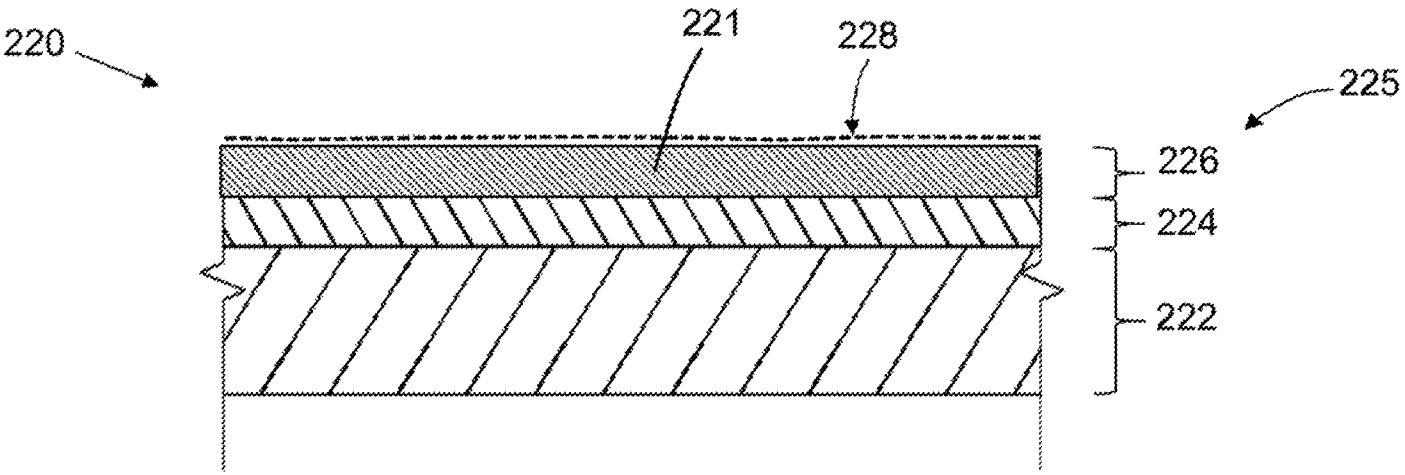
FIG. 10 illustrates a cross-section of a portion of a signal contact formed in accordance with an embodiment.

FIG. 10 illustrates a cross-section of a mating portion 221 of a signal contact 220 formed in accordance with an embodiment. The mating portion 221 represents the region of the signal contact 220 that directly engages another electrical contact. As shown, the signal contact 220 includes a base layer (or base material) 222, an intermediate or barrier layer 224 that is plated over the base layer 202, and a plated layer 226 that is plated over the intermediate layer 224. The base layer 222 may be, for example, a copper or copper alloy (e.g., beryllium copper). The intermediate layer 224 may include nickel and/or tin and may function as a diffusion barrier between the base layer 222 and subsequent layer(s). In some embodiments, the plated layer 206 comprise palladium-nickel. Alternatively, the plated layer 226 may be another precious metal material (e.g., gold alloy or silver alloy). The plated layer 226 may have a thickness that exceeds, for example, 30 microinches or 304 nanometers. The intermediate and the plated layers 224, 226 may be referred to collectively as a signal-material composition 225.

Optionally, a pore-blocking substance 228 may be coated onto the plated layer 226 such that the pore-blocking substance 228 is deposited within any pores of the plated layer 226. Various methods and pore-blocking substances, such as those described above, may be used.

Figure 11:
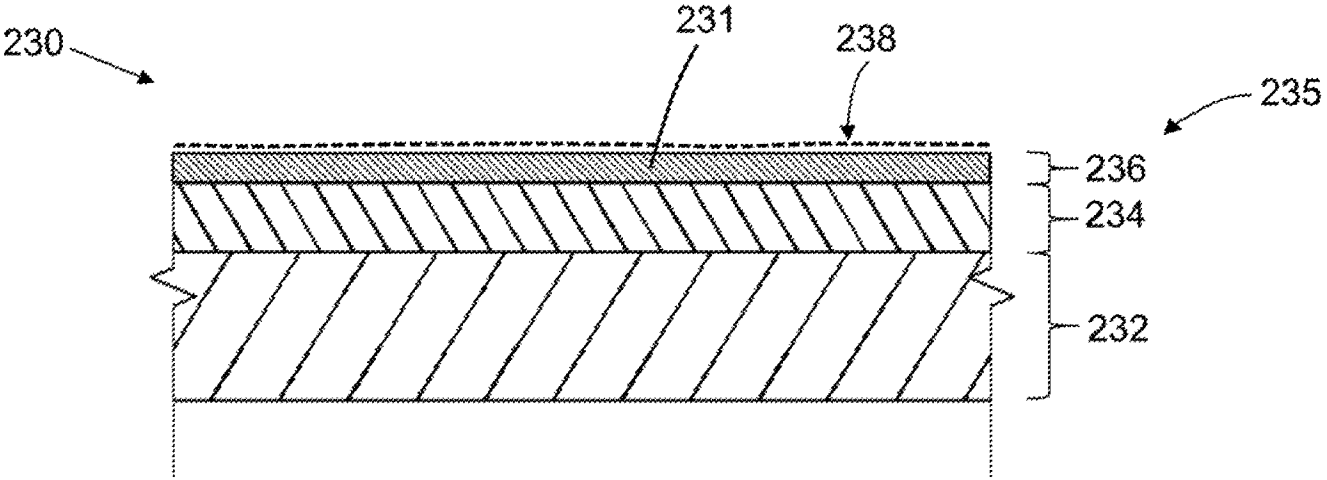
FIG. 11 illustrates a cross-section of a portion of a signal contact formed in accordance with an embodiment.

FIG. 11 illustrates a cross-section of a mating portion 231 of a ground contact 230 formed in accordance with an embodiment. The mating portion 231 represents the region of the ground contact 230 that directly engages another electrical contact. As shown, the ground contact 230 includes a base layer (or base material) 232, an intermediate or barrier layer 234 that is plated over the base layer 232, and a plated layer 236 that is plated over the intermediate layer 234. The base layer 232 may be, for example, a copper or copper alloy (e.g., beryllium copper). The intermediate layer 234 may include nickel and/or tin and may function as a diffusion barrier between the base layer 232 and subsequent layer(s). In some embodiments, the plated layer 236 comprise gold. The intermediate and the plated layers 234, 236 may be referred to collectively as a signal-material composition 235.

In particular embodiments, the plated layer 236 is a flash layer. For example, a flash layer may include gold, gold alloy, palladium, or palladium alloy and may be from about 2 to about 30 microinches (or about 50.8 nm to about 762 nm) depending upon the material. If the flash layer includes gold, the thickness may be from about 2 to about 12 microinches (or about 50.8 nm to about 304 nm). A flash layer comprising silver or silver alloy may be from about 2 to about 30 microinches (or about 50.8 nm to about 762 nm). Optionally, a pore-blocking substance 238 may be coated onto the plated layer 236 such that the pore-blocking substance 238 is deposited within any pores of the plated layer 236. Various methods and pore-blocking substances, such as those described above, may be used.

Accordingly, as illustrated in FIGS. 10 and 11, the signal contact 220 and the ground contact 230 may have the same layers (e.g., base layer, intermediate layer, and plated layer) that each have the same material (e.g., copper alloy, nickel, gold alloy). However, the signal and ground contacts 220, 230 have different thicknesses. Specifically, the plated layers 226 and 236 have different thicknesses. Accordingly, less precious metal material may be used for making the plated layer 236.

The following describes certain embodiments and provides examples of various elements and features using exemplary reference numbers. In some embodiments, an electrical connector (e.g., 14) is provided. The electrical connector includes a housing (e.g., 54) and a mating array (e.g., 21) having a plurality of signal contacts (e.g., 30) and a plurality of ground contacts (e.g., 36) that are coupled to the housing. The signal contacts and the ground contacts are positioned for mating with signal conductors (e.g., 28) and ground conductors (e.g., 34), respectively, of a mating connector (e.g., 12). The ground contacts are plated with a ground-material composition (e.g., 215, 235) and the signal contacts are plated with a signal-material composition (e.g., 205, 225). The ground-material composition is configured to cause a first low-level contact resistance (LLCR) while mated with the ground conductors during operation. The signal-material composition are configured to cause a second LLCR while mated with the signal conductors during operation. The second LLCR is less than the first LLCR during operation.

In some aspects, the signal-material composition (e.g., 205, 225) and the ground-material composition (e.g., 215, 235) differ by at least one of a material or a layer thickness.

In some aspects, the signal-material composition (e.g., 205, 225) is configured to cause the second LLCR while mated with the signal conductors (e.g., 28) during operation if the second LLCR is at most 20 milliohms after applying an accelerated-aging protocol. The ground-material composition (e.g., 215, 235) is configured to cause the first LLCR while mated with the ground conductors (e.g., 34) during operation if the first LLCR is at most 25 ohms after applying the accelerated-aging protocol. Optionally, the first LLCR is at least 10× greater than the second LLCR after applying the accelerated-aging protocol.

In some aspects, the ground-material composition (e.g., 215, 235) is configured to cause the first LLCR while mated with the ground conductors (e.g., 34) during operation if the first LLCR increases by at least three times after an accelerated-aging protocol is applied. The signal-material composition (e.g., 205, 225) is configured to cause the second LLCR while mated with the signal conductors (e.g., 28) during operation if the second LLCR increases by at most three times after the accelerated-aging protocol is applied. Optionally, the first LLCR is at most 10 ohms and the second LLCR is at most 20 milliohms. Also optionally, the first LLCR is at least 10× greater than the second LLCR after applying the accelerated-aging protocol.

In some aspects, the ground-material composition (e.g., 215, 235) includes a plated layer (e.g., 236) that has a first thickness and the signal-material composition (e.g., 205, 225) includes a plated layer (e.g., 226) that has a second thickness. The first thickness being less than the second thickness. Optionally, the first thickness is less than 0.30 micrometers and the second thickness is greater than 0.30 micrometers.

In some aspects, the signal-material composition (e.g., 205, 225) includes outer and inner signal layers having first and second materials, respectively, and the ground-material composition (e.g., 215, 235) includes outer and inner ground layers comprising the first and second materials, respectively. The outer layers of the signal-material composition (e.g., 205, 225) and the ground-material composition (e.g., 215, 235) have different thicknesses. Optionally, the ground-material composition (e.g., 215, 235) comprises at least one of a nickel sulfamate ($Ni(SO_3NH_2)_2$), tin-nickel (Sn/Ni), nickel-phosphorus (NiP), nickel-tungsten (NiW), structured nickel, cobalt-phosphorus (CoP), dilute palladium-nickel (PdNi), chromium (Cr), zinc (Zn), zinc-nickel (ZnNi), zinc with steel, carbon, a carbon ink, or a carbon epoxy.

In some aspects, the signal-material composition (e.g., 205, 225) includes outer and inner signal layers and the ground-material composition (e.g., 215, 235) includes outer and inner ground layers. The outer layers of the signal-material composition (e.g., 205, 225) and the ground-material composition (e.g., 215, 235) have different materials. Optionally, the outer layer of the signal-material composition (e.g., 205, 225) includes palladium-nickel (PdNi) and the outer layer of the ground-material composition (e.g., 215, 235) includes gold (Au).

In an embodiment, an electrical connector assembly is provided. The electrical connector assembly includes a mating connector (e.g., 12) having signal conductors (e.g., 28) and ground conductors (e.g., 34). The electrical connector (14) assembly also includes an electrical connector (e.g., 14) having a housing (e.g., 54) and a mating array (e.g., 21) that includes a plurality of signal contacts (e.g., 30) and a plurality of ground contacts (e.g., 36) that are coupled to the housing (e.g., 54). The signal contacts (e.g., 30) and the ground contacts (e.g., 36) are positioned for mating with the signal conductors (e.g., 28) and the ground conductors (e.g., 34), respectively, of the mating connector (e.g., 12). The ground contacts (e.g., 36) are plated with a ground-material composition (e.g., 215, 235), and the signal contacts (e.g., 30) are plated with a signal-material composition (e.g., 205, 225). The ground-material composition (e.g., 215, 235) and the ground conductors (e.g., 34) mating with each other at respective ground interfaces, and the signal-material composition (e.g., 205, 225) and the signal conductors (e.g., 28) mating with each other at respective signal interfaces. The ground interfaces have a first low-level contact resistance (LLCR) and the signal interfaces have a second LLCR, the second LLCR being less than the first LLCR.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing; and a mating array comprising a plurality of signal contacts and a plurality of ground contacts that are coupled to the housing, the signal contacts and the ground contacts being positioned for mating with signal conductors and ground conductors, respectively, of a mating connector;

wherein the ground contacts are plated with a ground-material composition and the signal contacts are plated with a signal-material composition, the ground-material composition configured to cause a first low-level contact resistance (LLCR) while mated with the ground conductors during operation, the signal-material composition configured to cause a second LLCR while mated with the signal conductors during operation, the second LLCR being less than the first LLCR during operation.

2. The electrical connector of claim 1, wherein the signal-material composition and the ground-material composition differ by at least one of a material or a layer thickness.

3. The electrical connector of claim 1, wherein:

the signal-material composition is configured to cause the second LLCR while mated with the signal conductors during operation if the second LLCR is at most 20 milliohms after applying an accelerated-aging protocol; and the ground-material composition is configured to cause the first LLCR while mated with the ground conductors during operation if the first LLCR is at most 25 ohms after applying the accelerated-aging protocol.

4. The electrical connector of claim 3, wherein the first LLCR is at least 10× greater than the second LLCR after applying the accelerated-aging protocol.

5. The electrical connector of claim 1, wherein:

the ground-material composition is configured to cause the first LLCR while mated with the ground conductors during operation if the first LLCR increases by at least three times after an accelerated-aging protocol is applied; and the signal-material composition is configured to cause the second LLCR while mated with the signal conductors during operation if the second LLCR increases by at most three times after the accelerated-aging protocol is applied.

6. The electrical connector of claim 5, wherein the first LLCR is at most 10 ohms and the second LLCR is at most 20 milliohms, the first LLCR being at least 10× greater than the second LLCR after applying the accelerated-aging protocol.

7. The electrical connector of claim 1, wherein the ground-material composition includes a plated layer that has a first thickness and the signal-material composition includes a plated layer that has a second thickness, the first thickness being less than the second thickness.

8. The electrical connector of claim 7, wherein the first thickness is less than 0.30 micrometers and the second thickness is greater than 0.30 micrometers.

9. The electrical connector of claim 1, wherein the signal-material composition includes outer and inner signal layers comprising first and second materials, respectively, and wherein the ground-material composition includes outer and inner ground layers comprising the first and second materials, respectively, wherein the outer layers of the signal-material composition and the ground-material composition have different thicknesses.

10. The electrical connector of claim 9, wherein the ground-material composition comprises at least one of a nickel sulfamate (Ni(SO3NH2)2), tin-nickel (Sn/Ni), nickel-phosphorus (NiP), nickel-tungsten (NiW), structured nickel, cobalt-phosphorus (CoP), dilute palladium-nickel (PdNi), chromium (Cr), zinc (Zn), zinc-nickel (ZnNi), zinc with steel, carbon, a carbon ink, or a carbon epoxy.

11. The electrical connector of claim 1, wherein the signal-material composition includes outer and inner signal layers and wherein the ground-material composition includes outer and inner ground layers, wherein the outer layers of the signal-material composition and the ground-material composition have different materials.

12. The electrical connector of claim 11, wherein the outer layer of the signal-material composition includes palladium-nickel (PdNi) and the outer layer of the ground-material composition includes gold (Au).

13. The electrical connector of claim 1, wherein the mating array is at least one of configured to transmit data at a rate of at least 10 gigabits/second (Gbps) or has at least 12 signal contacts per 100 mm2 along a mating side of the electrical connector.

14. An electrical connector assembly comprising:

a mating connector having signal conductors and ground conductors; and an electrical connector comprising:

a housing; and a mating array comprising a plurality of signal contacts and a plurality of ground contacts that are coupled to the housing, the signal contacts and the ground contacts being positioned for mating with the signal conductors and the ground conductors, respectively, of the mating connector;

wherein the ground contacts are plated with a ground-material composition and the signal contacts are plated with a signal-material composition, the ground-material composition and the ground conductors mating with each other at respective ground interfaces and the signal-material composition and the signal conductors mating with each other at respective signal interfaces, wherein the ground interfaces have a first low-level contact resistance (LLCR) and the signal interfaces have a second LLCR, the second LLCR being less than the first LLCR.

15. The electrical connector assembly of claim 14, wherein the signal-material composition and the ground-material composition differ by at least one of a material or a layer thickness and wherein the first LLCR is at least 10× greater than the second LLCR after applying an accelerated-aging protocol.

16. The electrical connector assembly of claim 14, wherein:

the ground interfaces have the first LLCR if the first LLCR is between 100 milliohms and 25 ohms after applying an accelerated-aging protocol; and the signal interfaces have the second LLCR if the second LLCR is at most 10 milliohms after applying the accelerated-aging protocol.

17. The electrical connector assembly of claim 14, wherein the ground-material composition includes an outer layer that has a first thickness and the signal-material composition includes an outer layer that has a second thickness, the first thickness being less than the second thickness.

18. The electrical connector assembly of claim 14, wherein the signal-material composition includes outer and inner signal layers comprising first and second materials, respectively, and wherein the ground-material composition includes outer and inner ground layers comprising the first and second materials, respectively, wherein the outer layers of the signal-material composition and the ground-material composition have different thicknesses.

19. An electrical connector comprising:

a housing; and a mating array comprising a plurality of signal contacts and a plurality of ground contacts that are coupled to the housing, the signal contacts and the ground contacts being positioned for mating with signal conductors and ground conductors, respectively, of a mating connector;

wherein the ground contacts have a plated layer that includes a precious metal and the signal contacts have a plated layer that includes the precious metal, the plated layers of the ground contacts and the plated layers of the signal contacts having different thicknesses, wherein the thickness of the plated layers of the signal contacts is greater than the thickness of the plated layers of the ground contacts.

20. The electrical connector of claim 19, wherein the ground contacts are configured to cause a first low-level contact resistance (LLCR) while mated with the ground conductors during operation, the signal contacts configured to cause a second LLCR while mated with the signal conductors during operation, the second LLCR being less than the first LLCR during operation.

21. The electrical connector of claim 20, wherein the first LLCR is at least 10× greater than the second LLCR after applying an accelerated-aging protocol.

* * * * *